US006474324B1

(12) United States Patent
Despart et al.

(10) Patent No.: US 6,474,324 B1
(45) Date of Patent: Nov. 5, 2002

(54) ARCHERY BOWS, ARCHERY BOW CAM ASSEMBLIES, AND ARCHERY BOW ANCHORS

(75) Inventors: James Robert Despart, Stephentown, NY (US); Terry G. Martin, Walla Walla, WA (US)

(73) Assignee: Martin Archery, Inc., Walla Walla, WA (US)

( * ) Notice: Subject to any disclaimer, the term of this patent is extended or adjusted under 35 U.S.C. 154(b) by 33 days.

(21) Appl. No.: 09/716,027

(22) Filed: Nov. 17, 2000

(51) Int. Cl.[7] ..... F41B 5/10
(52) U.S. Cl. ..... 124/25.6
(58) Field of Search ..... 124/23.1, 25.6, 124/86, 900

(56) References Cited

U.S. PATENT DOCUMENTS

| | | | | |
|---|---|---|---|---|
| 5,174,268 A | | 12/1992 | Martin et al. | 124/25.6 |
| 5,368,006 A | | 11/1994 | McPherson | 124/25.6 |
| 5,505,185 A | | 4/1996 | Miller | 124/25.6 |
| 5,623,915 A | * | 4/1997 | Kudlacek | 124/25.6 |
| 5,687,703 A | * | 11/1997 | Vyprachticky | 124/25.6 |
| 5,697,355 A | * | 12/1997 | Schaffer | 124/25.6 |
| 5,782,229 A | | 7/1998 | Evans et al. | 124/25.6 |
| 5,791,322 A | | 8/1998 | McPherson | 124/25.6 |
| 5,803,069 A | * | 9/1998 | Schreiber | 124/86 |
| 5,890,480 A | | 4/1999 | McPherson | 124/25.6 |
| 5,947,099 A | * | 9/1999 | Derus | 124/25.6 |
| 5,975,067 A | | 11/1999 | Strother | 124/25.6 |

* cited by examiner

*Primary Examiner*—John A. Ricci
(74) *Attorney, Agent, or Firm*—Wells St. John P.S.

(57) ABSTRACT

In one aspect, the invention includes an archery bow having a first limb and a second limb, and a handle between the limbs. A rotating member includes at least two cams rotatably joined to the first limb with a first of the at least two cams having an eccentric profile to provide a first camming surface and a second of the at least two cams having an eccentric profile to provide a second camming surface. The eccentric profile of the first cam is substantially symmetrical relative to the eccentric profile of the second cam. A string extends between the rotating member and second limb.

69 Claims, 14 Drawing Sheets

22
18
24

26
25
44
44
50
50
62
46
46
46
60
62
60
23
58
21
56
22

ARCHERY BOWS, ARCHERY BOW CAM ASSEMBLIES, AND ARCHERY BOW ANCHORS

TECHNICAL FIELD

The invention pertains to archery bows, archery bow cam assemblies, and archery bow anchors.

BACKGROUND OF THE INVENTION

Various types of archery bows have been developed, including traditional bows (i.e., long bows and recurved bows) and compound bows. All archery bows include a pair of opposed limbs extending from a handle of the bow. As an archer draws the bow by pulling on a drawstring, the limbs flex and store energy. This energy is transferred to the arrow as the archer releases the drawstring.

A compound bow is a popular design for archery bows and comprises incorporating one or more cams (for example, eccentric wheels or pulleys) into the bow. These bows use a cable system which extends over at least one cam rotatably mounted at a distal end of a bow limb to provide a mechanical advantage during the drawback of the drawstring. Such cams enable a peak draw force (i.e., a peak pull force on a drawstring of a bow to maintain a draw) to be reached in the middle of a draw such that the draw force drops at full draw.

With this arrangement, when the drawstring is in the full draw position, maximum potential energy is stored in the bow while the force required to maintain the drawstring in the full draw position is less than the maximum draw force of the bow. In short, as the drawstring is being drawn, the draw force applied to the bow increases to a maximum force and reduces to a lower draw force at the full draw position. Accordingly, maximum energy is stored in the limbs without requiring maximum force to be applied to the drawstring to hold the bow at the full draw position. This permits the archer to maintain aim on his target prior to release for a longer period of time for a better shot.

A general goal of archery bow designs is to increase the speed in which an arrow is projected by a bow. Arrows which fly faster can maintain a flatter trajectory over a greater distance than slower traveling arrows. This can enable faster flying arrows to be fired more accurately than slower traveling arrows.

Methods to increase arrow speed include maximizing energy transferred to the arrow from the bow. Accordingly, one general goal of archery bow design is to alleviate twisting of bow limbs that occurs during a draw. The twisting of bow limbs uses energy that cannot be transferred to the arrow, and therefore, the energy is lost for increasing arrow speed.

Another goal of archery bow designs is to decrease frictional forces between moving components within a bow, such as, for example, bearings and axles. The more frictional forces associated with moving components, the more energy not available for increasing arrow speed.

A general goal of compound bow designs is to provide a cable system that allows for fletching and sighting clearances. A fletching clearance is the area of clearance needed for the cross-sectional area of a bow shaft and radially extending feathers to pass unimpeded. A sighting clearance is a region for aiming at a target unimpeded by the cable system. The conventional method for establishing fletching and sighting clearances is to provide cable guards. However, the cable guards create unbalanced forces in the limbs which twist the limbs detrimentally as discussed previously.

In light of the above discussed goals, it would be desirable to develop an archery bow to minimize the above-mentioned design inefficiencies and difficulties.

SUMMARY OF THE INVENTION

In one aspect, the invention includes an archery bow having a first limb and a second limb, and a handle between the limbs. A rotating member comprises at least two cams rotatably joined to the first limb with a first of the at least two cams having an eccentric profile to provide a first camming surface and a second of the at least two cams having an eccentric profile to provide a second camming surface. The eccentric profile of the first cam is substantially symmetrical relative to the eccentric profile of the second cam. A string extends between the rotating member and second limb.

In another aspect, the invention includes an archery bow having a pair of flexible resilient bow limbs forming first and second outer bow limb ends and forming first and second inner bow limb ends. A handle connects the first and second inner bow limb ends and a string extends between the first and second outer bow limb ends. At least four cables extend between the first and second outer bow limb ends.

In yet another aspect, the invention includes an archery bow cam assembly having a first cam with an eccentric profile to provide a first camming surface. A second cam has an eccentric profile to provide a second camming surface and the eccentric profile of the first cam is substantially symmetrical relative to the eccentric profile of the second cam. The archery bow cam assembly includes a primary cam between the first and second cams.

In still another aspect, the invention includes an archery bow anchor having an outward surface with a plurality of peripheral discrete grooves. Each groove is laterally displaced from an adjacent groove.

BRIEF DESCRIPTION OF THE DRAWINGS

Preferred embodiments of the invention are described below with reference to the following accompanying drawings.

FIG. 4 is an exploded view of the archery bow cam of FIG. 3.

FIG. 10 is a fragmentary view of an archery bow from the perspective of an archer using the bow and shown in a rest position relative a full draw.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
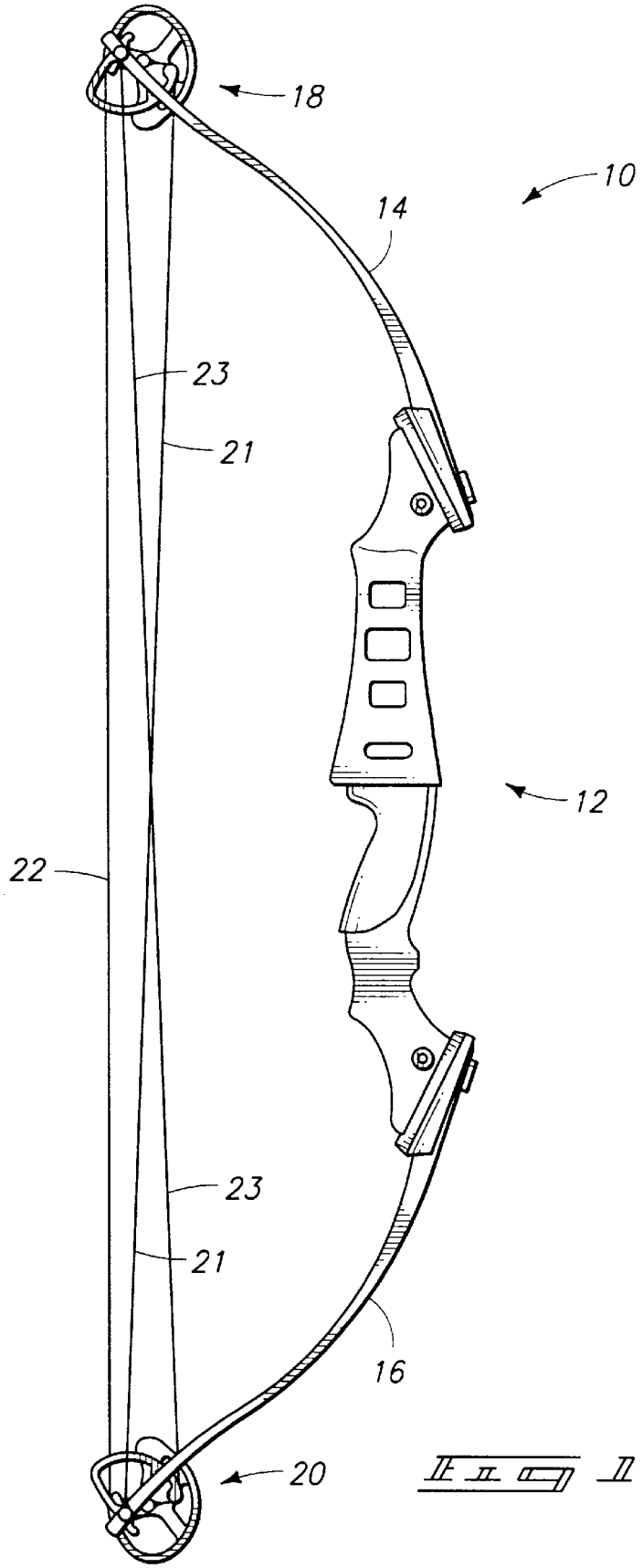
FIG. 1 is a diagrammatic side view of a first embodiment archery bow of the present invention.

FIG. 1 shows a first embodiment archery bow 10 of the present invention. Archery bow 10 comprises a handle 12, and a pair of limbs 14 and 16 attached to handle 12. Exemplary bow 10 further comprises a first rotating member 18 rotatably attached to limb 14 and a second rotating member 20 rotatably attached to limb 16. A cable, for example a string or drawstring 22, extends between first and second limbs 14 and 16. In one embodiment, string 22 extends between first and second rotating members 18 and 20. A plurality of cables 21 and 23, for example power cables, extend between first and second limbs 14 and 16. This exemplary bow embodiment illustrates the first rotating member 18 having the same configuration as the second rotating member 20. Accordingly, any subsequent description regarding first rotating member 18 applies equally to rotating member 20. It should be understood, however, that rotating member 20 could be different than member 18, and could, for example, be an idler wheel. It should also be understood second limb 16 may not have a rotating member, and that cables could be directly attached to limb 16.

Figure 2:
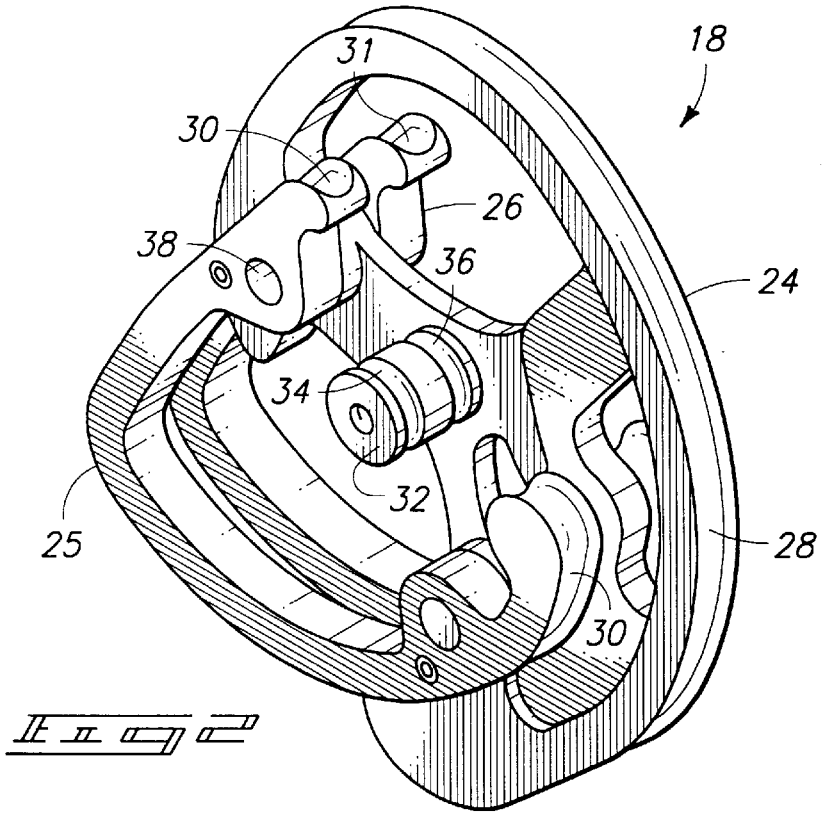
FIG. 2 is a perspective view of an archery bow cam in accordance with a first embodiment of the present invention.
Figure 3:
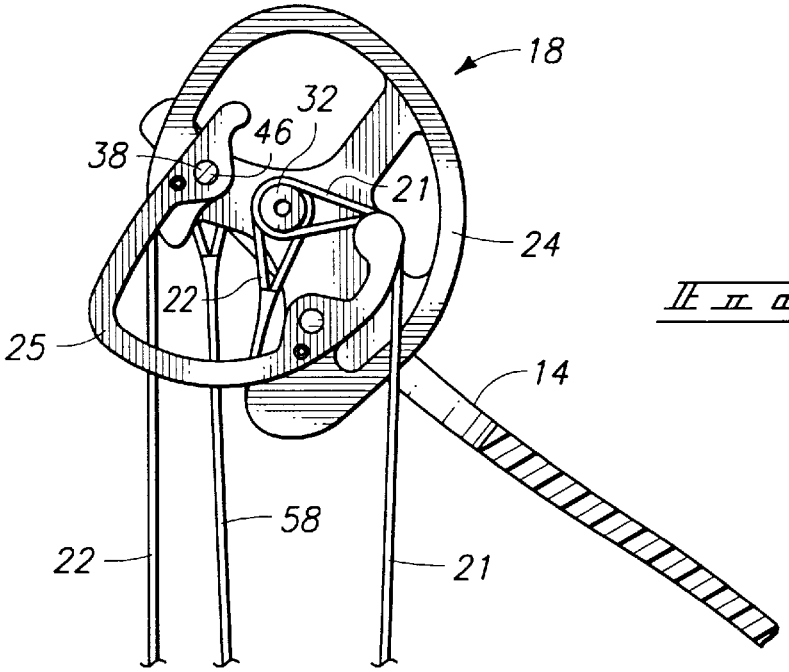
FIG. 3 is a fragmentary view of the archery bow of FIG. 1 emphasizing a side view of the archery bow cam of FIG. 2 shown at a rest position relative a full draw.
Figure 3:
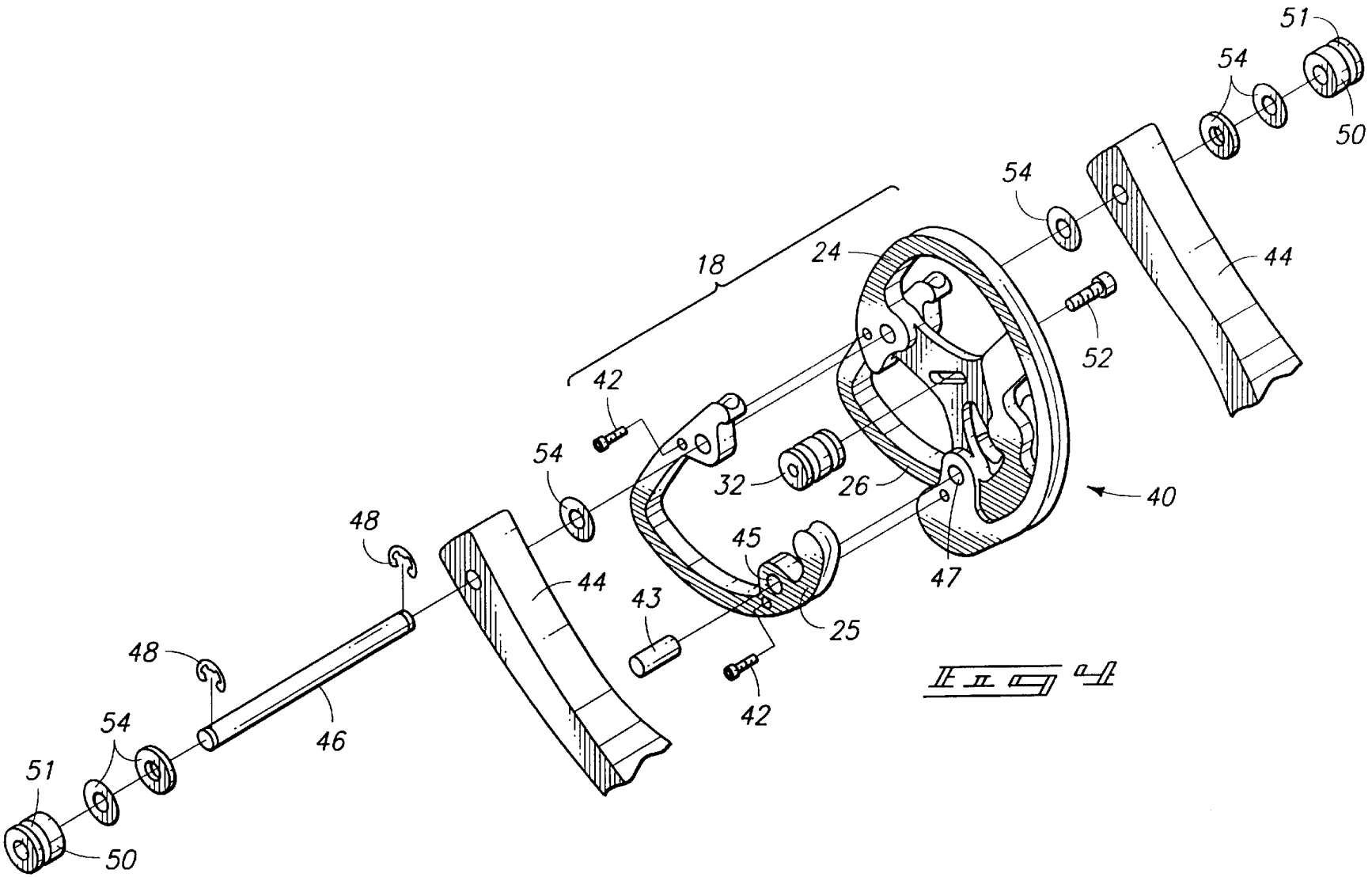

A first embodiment of rotating member 18 is illustrated in FIG. 2 and comprises a plurality of cams, for example, a primary cam 24 between at least two cams. In the shown embodiment, primary cam 24 is between a first cam 25 and a second cam 26. First cam 25 comprises an eccentric profile to provide a first camming surface 30 and second cam 26 comprises an eccentric profile to provide a second camming surface 31. In this exemplary embodiment of rotating member 18, the eccentric profile of first cam 25 is substantially symmetrical relative to the eccentric profile of second cam 26. In this document, substantially symmetrical and substantially symmetrically aligned mean symmetry and alignment within tolerances of fabrication techniques. Additionally, the eccentric profiles are aligned wherein the eccentric profile of first cam 25 forms substantially a mirror image of the eccentric profile of second cam 26 relative primary cam 24. In this document, mirror image means alignment within fabrication tolerances. Primary cam 24 comprises an eccentric profile to provide another camming surface 28, and the eccentric profile of primary cam 24 is not substantially symmetrical relative the eccentric profiles of first and second cams 25 and 26. Camming surfaces 28, 30 and 31 form grooves to receive cables. Exemplary first and second cams 25 and 26 are parallel and equidistant relative primary cam 24. An anchor 32, for example a cable anchor, laterally extends from first rotating member 18 and comprises grooves 34 and 36 to receive, or anchor, cables. An opening 38 in rotating member 18 receives an axle (FIG. 3). The substantially symmetrical design of rotating member 18 allows for the forces created in rotating member 18 by cables riding over the camming surfaces to be balanced, and therefore, alleviates unbalanced forces exist to be distributed unevenly within limb 14 causing twisting of limb 14.

Referring to FIG. 3, rotating member 18 is illustrated with string 22 at a rest position relative a full draw position, i.e., no pull force is applied to string 22. Rotating member 18 receives an axle 46 in opening 38 to rotatably join rotating member 18 to first limb 14. Cable 21 is received over first cam 25 and secured to cable anchor 32 in groove 34. String 22 is received over primary cam 24 and secured to cable anchor 32 in groove 36.

Referring to FIG. 4, an exemplary embodiment of rotating member 18 includes primary cam 24 and second cam 26 formed as a one piece member 40, and first cam 25 formed as a discrete member secured to the one piece member 40 by threaded members 42. A stabilizer member 43 is received in aligned openings 45 and 47 of first cam 25 and one piece member 40, respectively, for added support between first cam 25 and one piece member 40. Limb 14 includes a distal end that comprises forked members 44 in which rotating member 18 is rotatable secured on axle 46. Axle 46 is secured to forked members 44 by clips 48, and exemplary clips comprise c-clips. In one embodiment, the axle 46 extends outwardly from each forked member 44 to receive an anchor, for example an axle anchor 50, having a peripheral groove 51 to receive cables. Threaded member 52 secures cable anchor 32 to one piece member 40. Various washers 54 may be used to relieve friction and distribute pressure between the anchors 50, axle 46 and forked members 44. It should be understood that rotating member 18 could be manufactured as one piece comprising primary cam 24 and first and second cams 25 and 26. Furthermore, it should be understood that rotating member 18 could be manufactured as three discrete pieces comprising primary cam 24, first cam 25 and second cam 26, and subsequently assembled and secured together by, for example, threaded members.

Figure 5:
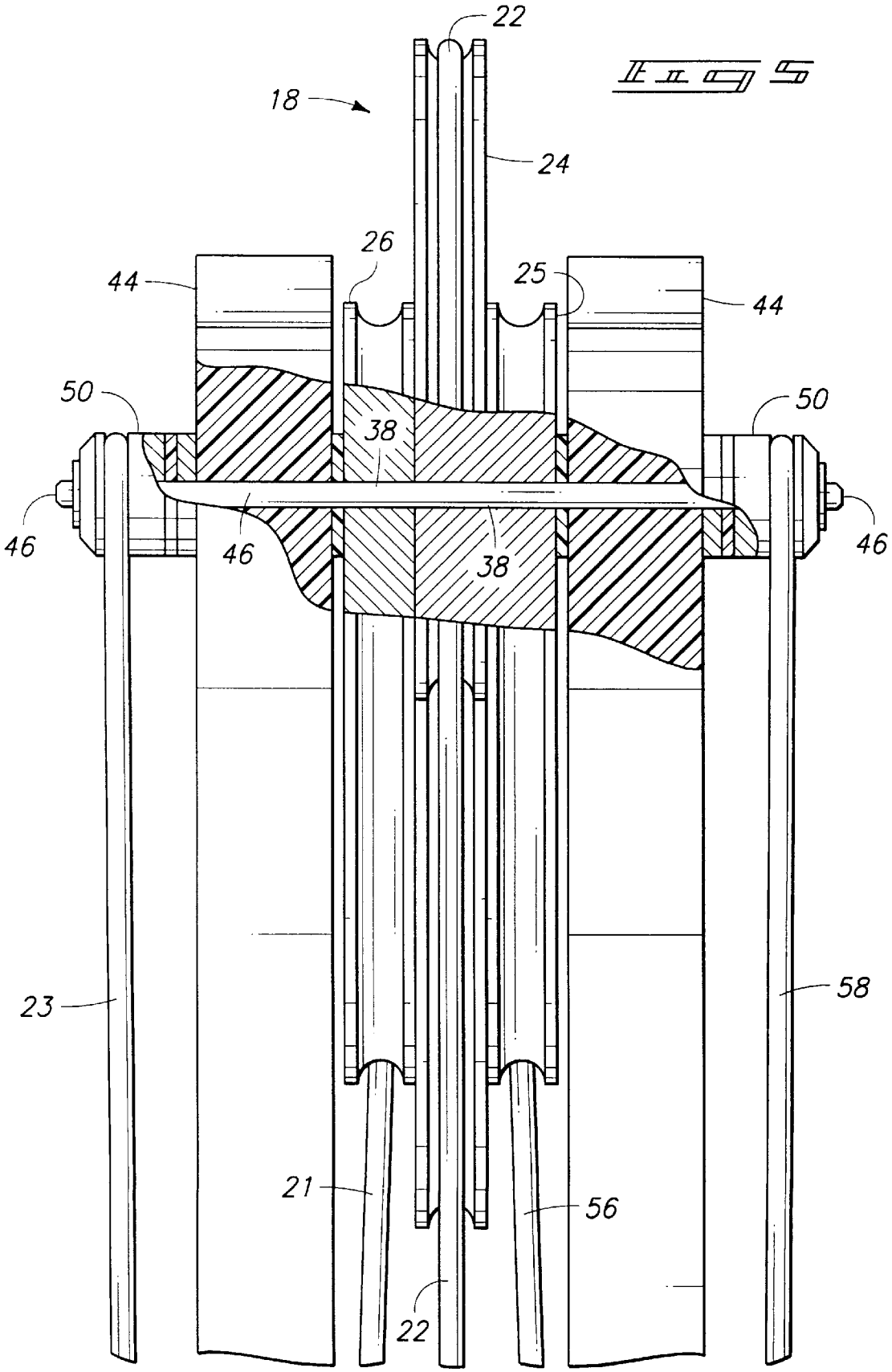
FIG. 5 is an enlarged fragmentary partial sectional view of an archery bow in accordance with a first embodiment of the present invention.

Referring to FIG. 5, a first embodiment of a rotating member 18 cooperating between forked members 44 is illustrated wherein the entire width of rotating member 18 rotatably rests on axle 46 for rotatable support. It should be understood that opening 38 could have enlarged diametric dimensions partially along the width of rotating member 18, for example, for the entire width of primary cam 24, such that the entire width of rotating member 18 structure does not contact axle 46 thereby reducing friction between the components. It should be understood that rotating member 18 may only contact axle 46 in a central portion of primary cam 24. Furthermore, it should be understood that rotating member 18 could make intermittent contact with axle 46 along its entire width for rotatable support. Lessening contact between axle 46 and rotating member 18 reduces friction to provide a more efficient archery bow 10, allowing more energy to transfer from the bow 10 to an arrow.

Figure 6:
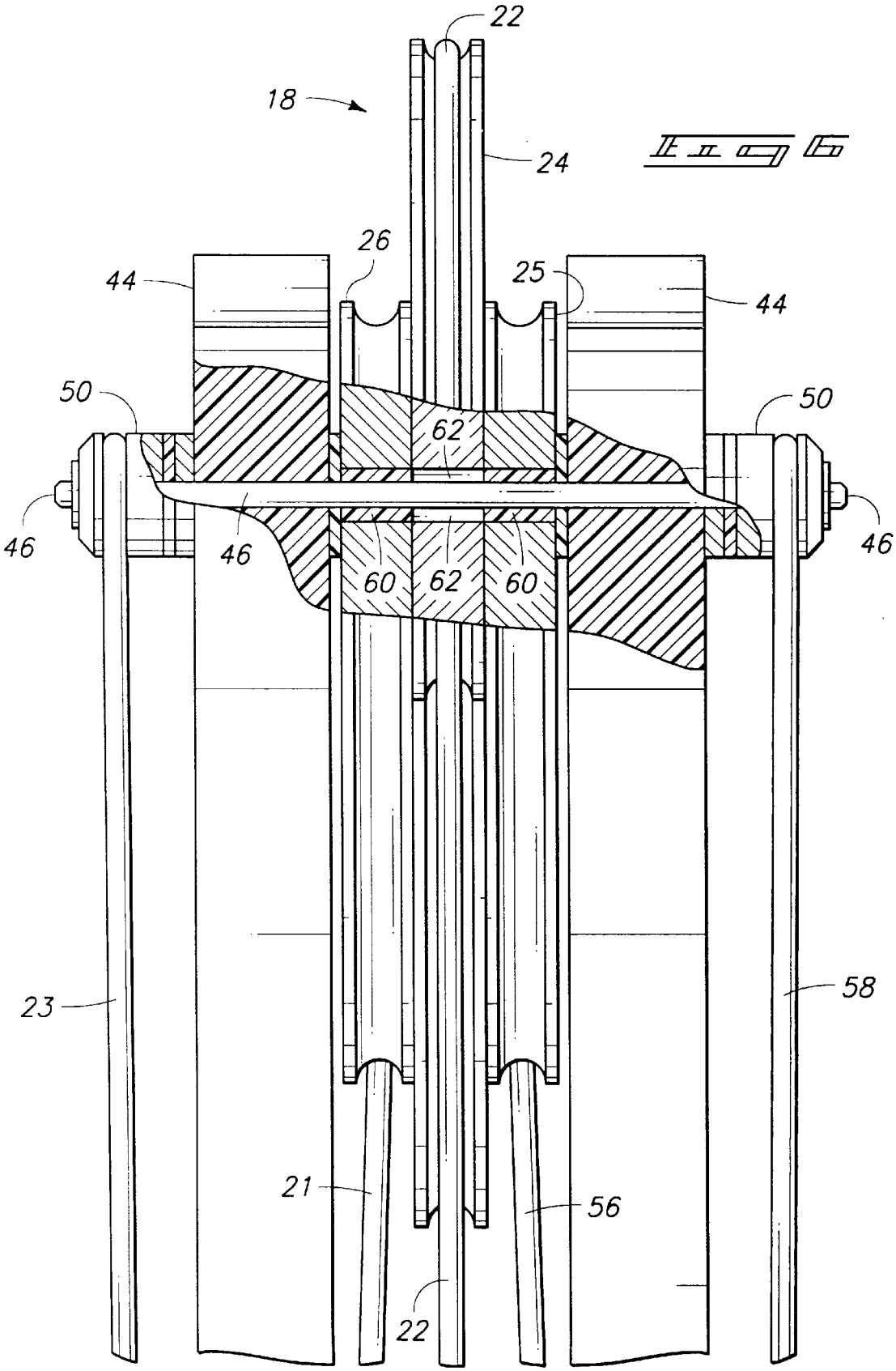
FIG. 6 is an enlarged fragmentary partial sectional view of an archery bow in accordance with a second embodiment of the present invention.

A second embodiment of a rotating member 18 cooperating between fork members 44 is illustrated in FIG. 6. Bearings 60 rotatably support rotating member 18 by supporting first and second cams 25 and 26 on axle 46 with primary cam 24 defining an opening 62 having a greater diameter than the diameter of axle 46, and therefore, primary cam 24 does not contact axle 46. It should be understood that a third bearing could occupy opening 62 to support primary cam 24 on axle 46, either in combination with bearings 60, or without bearings 60. It should be understood one continuous bearing could support rotating member 18 along its entire width. Additionally, it should be understood that intermittently spaced plurality of discreet bearings could be spaced along the width of rotating member 18.

Figure 7:
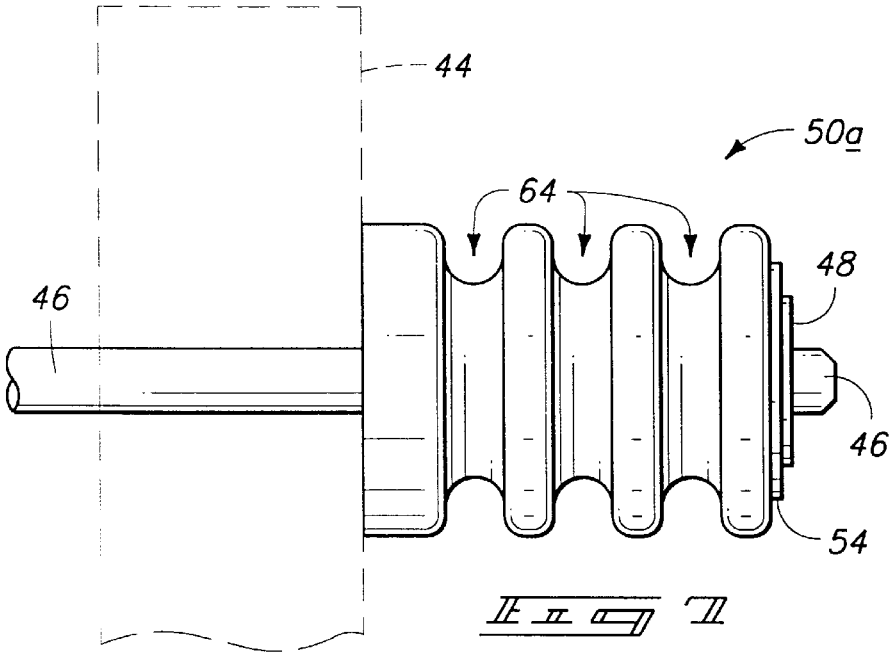
FIG. 7 is a side view of a cable anchor in accordance with a first embodiment of the present invention, and shown in cooperation with a archery bow limb (illustrated in phantom).

In referring to subsequent figures, similar numbering to that utilized in describing the first embodiments of FIGS. 1–6 will be used, with differences indicated by the suffix "a","b", "c", or by different numerals. Referring to FIG. 7, an embodiment of an anchor 50*a*, for example a cable anchor or axle anchor, is shown laterally extending from forked member 44 (shown in phantom) of a bow limb and supported on axle 46 by washer 54 and clip 48. Anchor 50*a* comprises generally a cylindrical shape having a plurality of discrete circumferential grooves 64 and each groove 64 is laterally displaced from an adjacent groove 64. Each groove 64 is capable of receiving a cable to provide lateral adjustment of a cable relative the bow 10 or string 22. Accordingly, cable guards routinely used to spread cables from a drawstring are not needed. Exemplary plurality of grooves of the shown embodiment comprise three grooves 64 incrementally spaced laterally from adjacent grooves 64.

Figure 8:
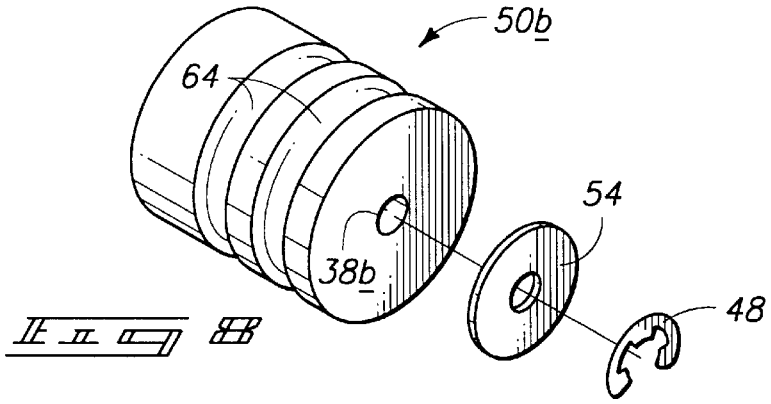
FIG. 8 is a perspective view of the cable anchor in FIG. 7.

Referring to FIG. 8, one embodiment of an anchor 50*b* comprises one or more grooves 64 with a cylindrical opening 38*b* to receive axle 46 (FIG. 7).

Figure 9:
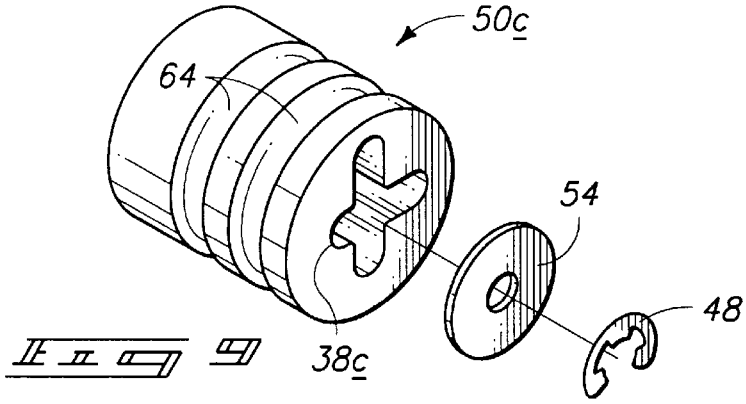
FIG. 9 is a perspective view of a cable anchor in accordance with another embodiment of the present invention.

Referring to FIG. 9, another embodiment of an anchor 50*c* comprises one or more grooves 64 with an opening 38*c*. Opening 38*c* is contoured to receive axle 46 for adjusting movement of anchor 50*c* on axle 46. In one embodiment, opening 38*c* defines two intersecting oblong openings to allow anchor 50*c* to move generally perpendicularly relative a longitudinal axis of axle 46. An anchor 50*c* capable of such movement relative the axle 46 allows for adjustment of tension in cables which are mounted to anchor 50*c*. It should be understood that anchor embodiments 50*a*, 50*b* and 50*c* could be positioned on axle 46 between forked members 44 and rotating member 18. Additionally, it should be understood that the opening or openings within an anchor to receive an axle can be designed as any shape limited only by the imagination of the designer.

Figure 11:
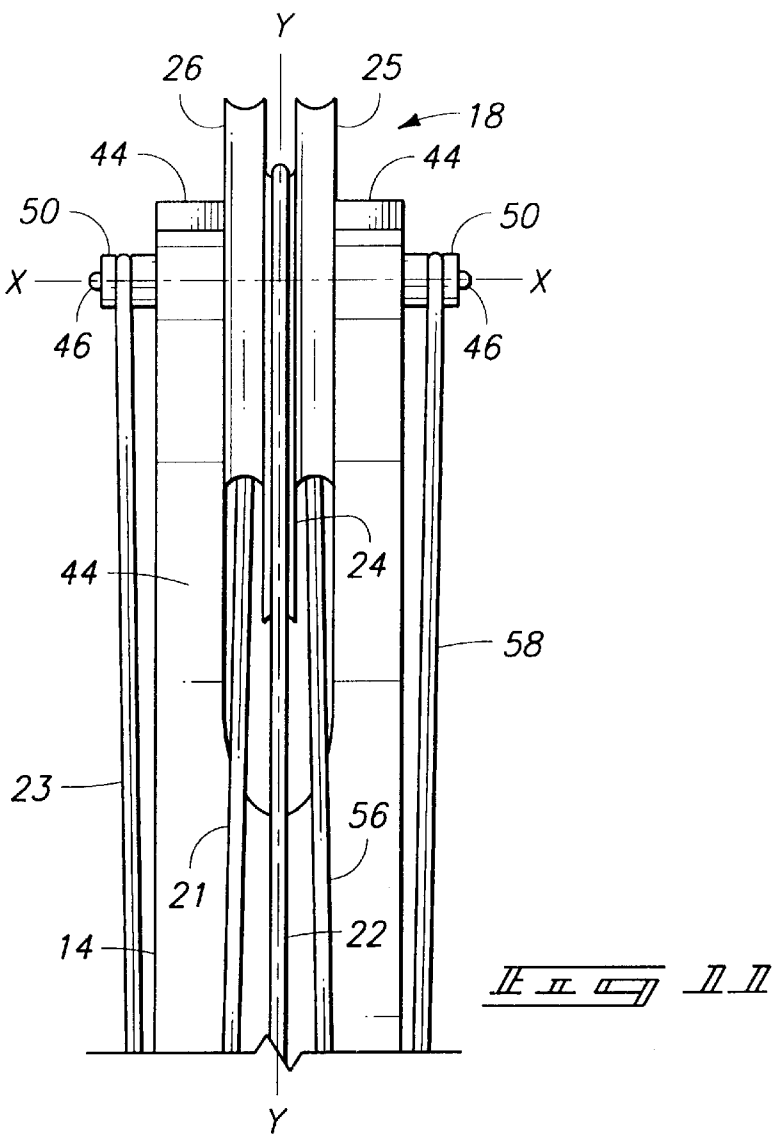
FIG. 11 is a fragmentary view of the FIG. 10 archery bow shown in a full draw position.
Figure 11:
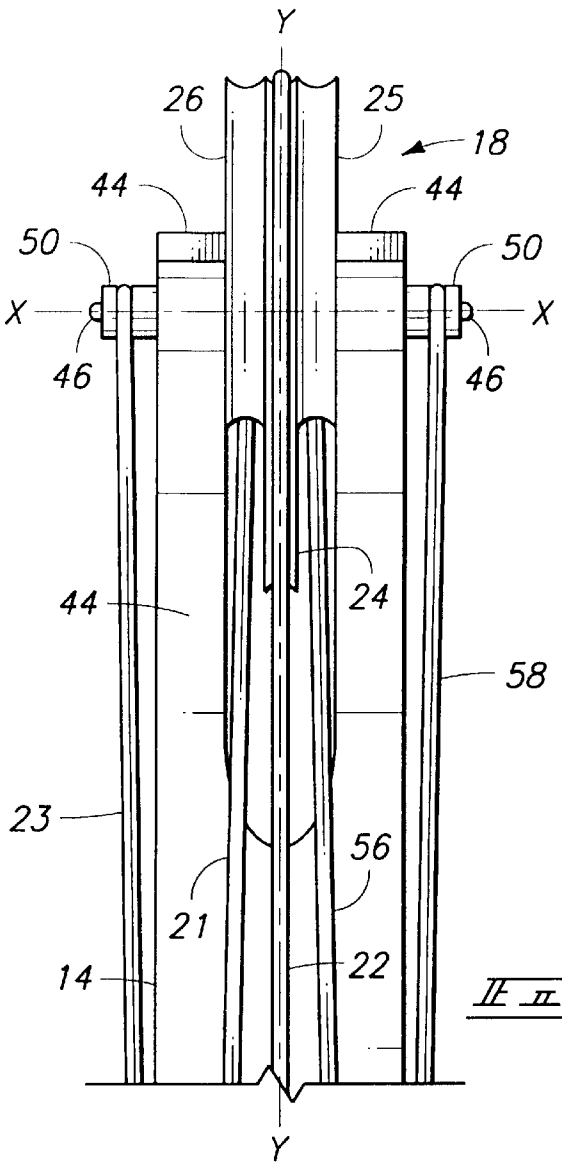

FIGS. 10 and 11 illustrate rotating member 18 in a rest position and a draw position, respectively. Referring to FIG. 10, archery bow 10 is illustrated at a rest position, i.e., no pull force is applied to string 22, and therefore, rotating member 18 is in a rest position without rotation on the axle 46. An x-axis is oriented along axle 46 and an y-axis perpendicular to the x-axis is oriented along string 22 for illustration purposes.

Referring to FIG. 11, archery bow 10 is illustrated at a full draw position, i.e., the string 22 has been pulled from bow 10 and is in a static position. The rotating member 18 has rotated on axle 46. As illustrated, the x- and y-axes are oriented the same as in FIG. 10 demonstrating no twisting of forked members 44 or first limb 14. Whether the rotating member 18 is in the rest position, or rotated somewhere between the rest position up to the full draw position, the x- and y-axes are oriented the same. Since the tensile forces in the cables are balanced on the rotating member 18 relative the centrally located primary cam 24, no unbalanced forces exist to be transferred into forked member 44 and limb 14. The limbs of a conventional bow have unbalanced forces in the limbs because the rotating members are not substantially symmetrically designed to evenly distribute the tensile forces in the cables. Accordingly, a plane established by the x- and y-axes (i.e., the plane of the page) would be rotated around an imaginary z-axis extending perpendicularly from the page. Additionally, for a conventional bow, the x-axis would be rotated around the y-axis. This twisting of the limbs depletes the energy that can be used to drive the arrow.

Figure 12:
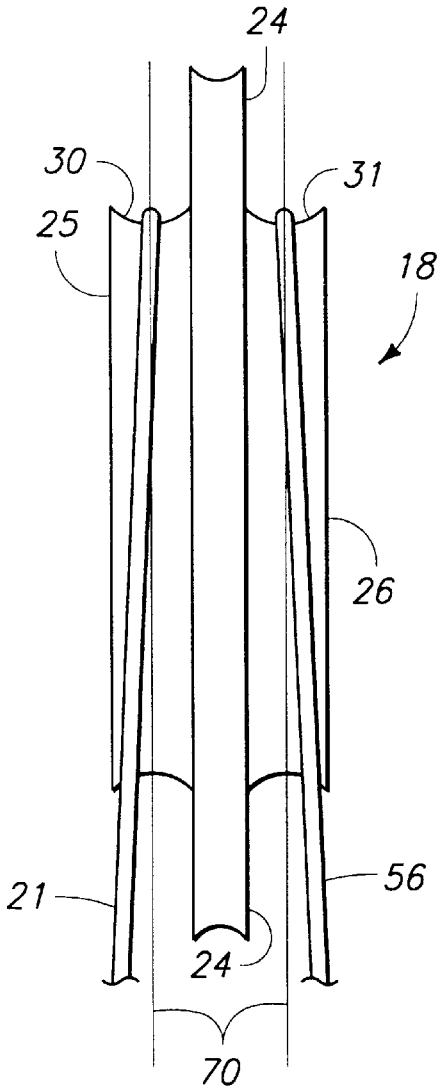
FIG. 12 is a front view of the FIG. 2 archery bow cam.

Referring to FIG. 12, an exemplary rotating member 18 is shown. Axis 70 marks the centerline of grooves 30 and 31 for first and second cams 25 and 26, respectively. In this embodiment, cables 21 and 56 ride in grooves 30 and 31, respectively, angled from axis 70.

Figure 13:
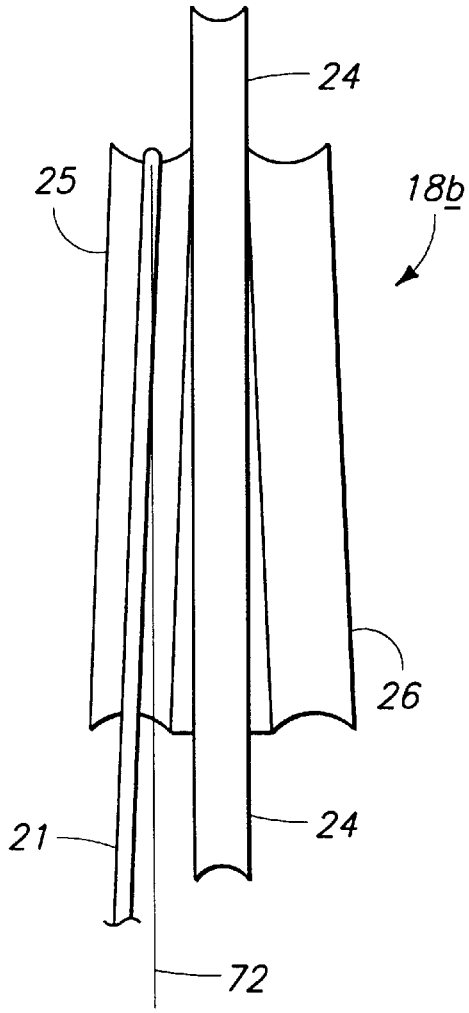
FIG. 13 is a front view of an archery bow cam in accordance with another embodiment of the present invention.

Referring to FIG. 13, another embodiment of rotating member 18b is illustrated. First and second cams 25 and 26 are angled from primary cam 24 while still maintaining a mirror image relationship. Accordingly, cables 21 and 56 are aligned with axis 70 of grooves 30 and 31. Centering the cables within the cams can increase the longevity of usefulness of the cables.

Figure 14:
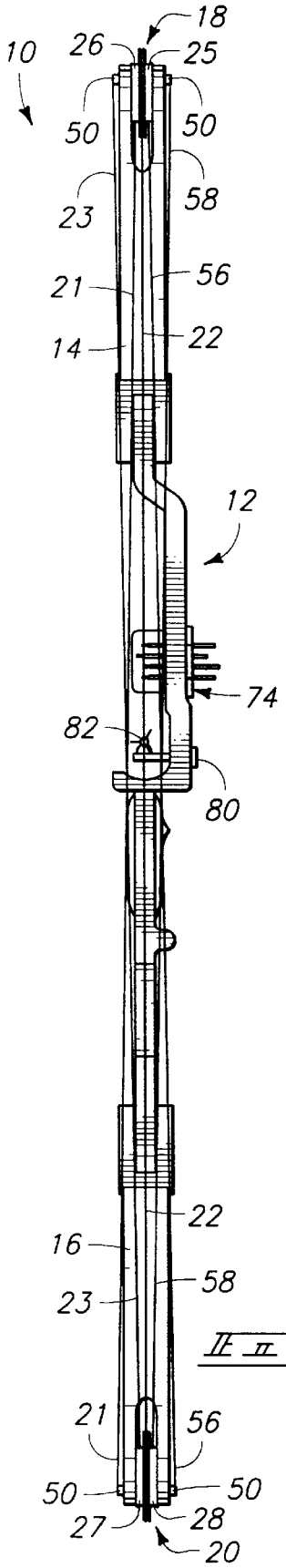
FIG. 14 is a view of the FIG. 1 archery bow from the perspective of an archer using the present invention, this embodiment including additional components than shown in the FIG. 1 bow.

Referring to FIG. 14, an embodiment of archery bow 10 is shown from the perspective an archer using bow 10. Limb 14 rotatably supports rotating member 18 and limb 16 rotatably supports rotating member 20. Bow 10 includes a sighting apparatus 74 and an arrow rest 80 to receive an arrow 82. This perspective illustrates the configuration of string 22 and four cables 21, 23, 56, and 58 on archery bow 10. For sake of discussion, consider a plane defined by the string 22 extending out of the page and centrally through bow 10. Accordingly, two sides of bow 10 are defined, a right side and a left side relative the plane. Each side of the plane includes two cables extending between the limbs 14 and 16. For example, cables 21 and 23 extend between limbs 14 and 16 on the left side of the plane and cables 56 and 58 extend between limbs 14 and 16 on the right side of the plane. Each cable is a discrete cable and comprises two terminal ends. One terminal end is secured to an axle anchor of one limb and the other terminal end is secured to the rotating member on the other limb on the same side of bow 10. For example, one end of cable 23 extends from axle anchor 50 of limb 14 on the left side of bow 10 to ride over cam 27 on the left side of rotating member 20 of limb 16 and anchors to rotating member 20. One end of cable 21 is anchored to rotating member 18 of limb 14 on the left side of bow 10 and rides over cam 26 on the left side to extend to limb 16 and anchors to axle anchor 50 on the left side of bow 10. This cable configuration of cables 21 and 23 is a mirror image of cable configuration of cables 56 and 58 on the right side of the bow 10 relative the plane. Due to this symmetry between the cables on either side of string 22, the tensile forces in the cables on the left side are balanced with the tensile forces in the cables on the right side.

Figure 15:
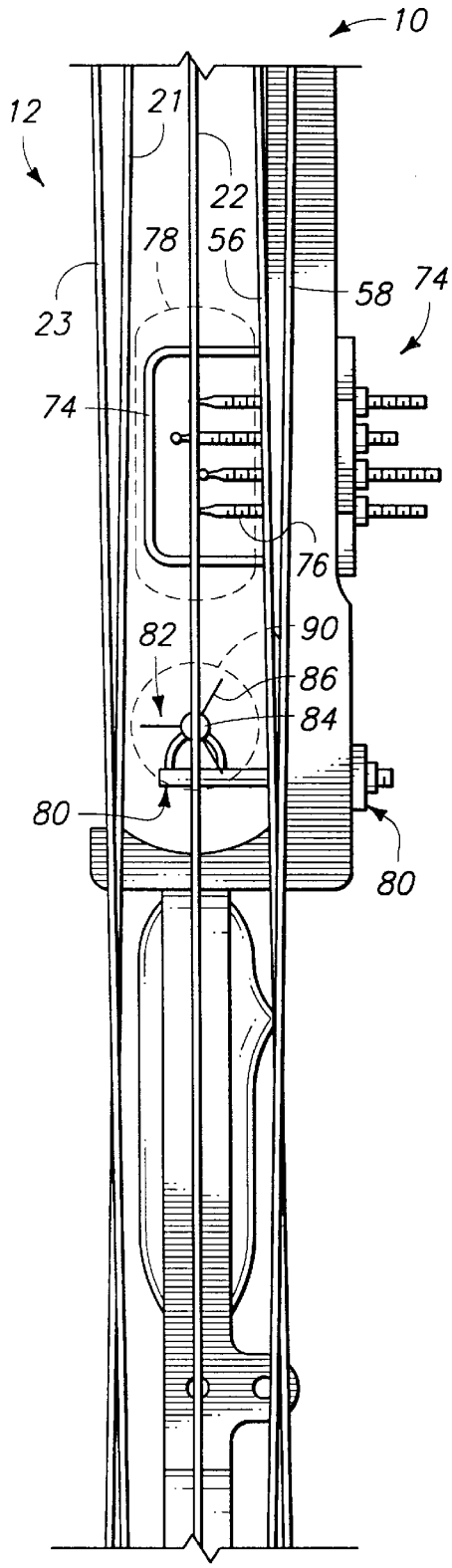
FIG. 15 is an enlarged fragmentary view of the FIG. 14 archery bow.

Referring to FIG. 15, an enlarged portion of bow 10 from FIG. 14 is shown, particularly emphasizing the area around handle 12. The sighting apparatus 74 defines a region termed a sighting clearance 78 (shown in phantom) for an archer to aim arrow 82 at a target. Arrow 82 is supported on bow 10 by an arrow rest 80. The arrow 82 comprises a plurality of vanes or feathers 86, for example three, and a nock 84 that secures the arrow 82 to string 22. The cross-sectional area of the arrow and radially extending feathers 86 define a region termed a fletching clearance 90 (shown in phantom). The sighting clearance 78 and fletching clearance 90 are unimpeded by cables 21, 23, 56 and 58 traversing the clearance regions 78 and 90. Two reasons account for the clearances 78 and 90 being unimpeded. First, since the symmetry of the cable configuration has each cable extending between the limbs on the same side of the bow, no cable crosses into the clearance regions 78 and 90. Secondly, the use of axle anchors described previously regarding FIGS. 7–9 allows for adjustment of the cables away from the clearance regions as needed.

Conventional bows routinely use less than four cables and a string. Increasing the number of cables secured between limbs of the archery bow allows for decreasing the diameter dimensions of at least one cable. For example, one or more of cables 21, 23, 56, and 58 may include diameter dimensions greater than 0 inch and less than ⅛ inch, for example, from about 3⁄32 inch to less than ⅛ inch. An exemplary diametric range comprises from about 3⁄32 inch to less than ⅛ inch. The string may include diameter dimensions ranging from about 1⁄16 inch to less than 3⁄16 inch. Smaller dimensioned cables and string can increase the efficiency of a bow.

Figure 16:
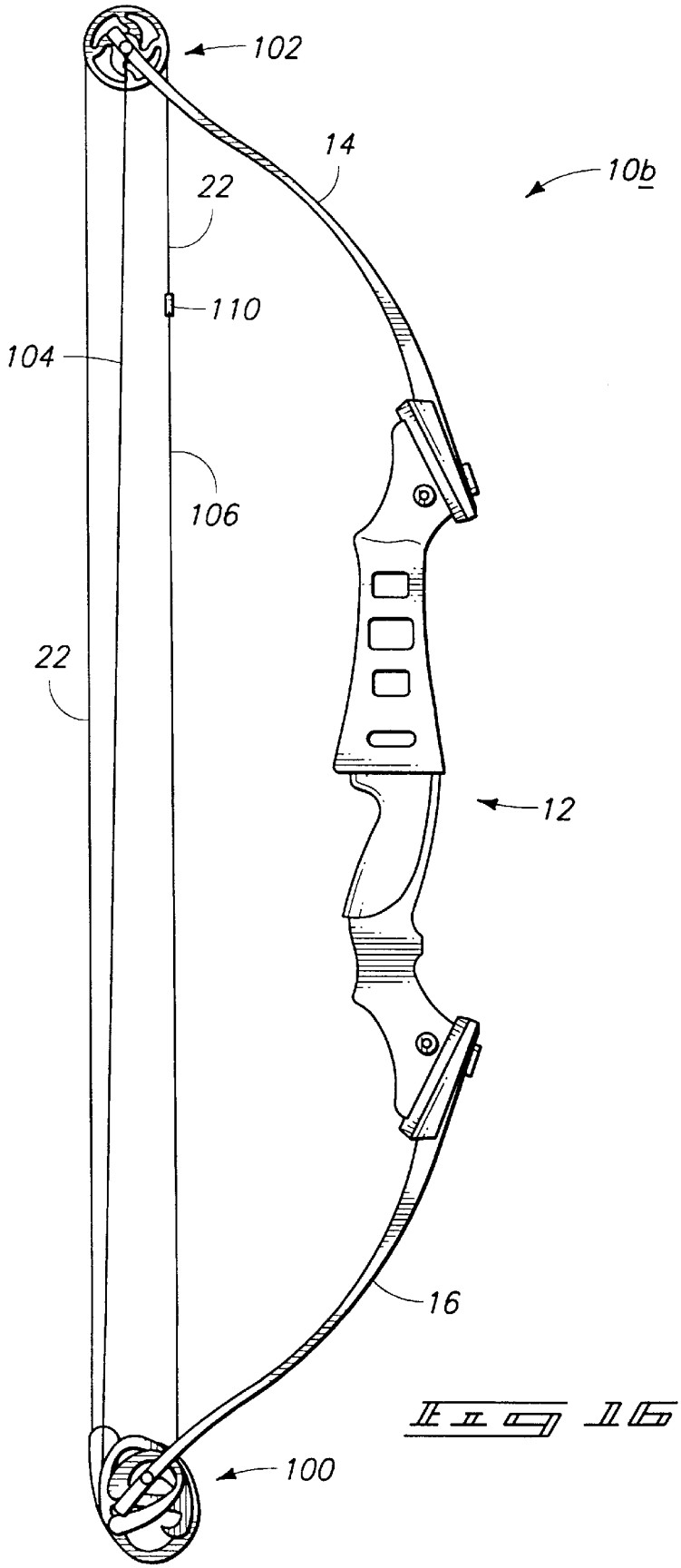
FIG. 16 is a diagrammatic side view of an archery bow in accordance with another embodiment of the present invention.

Referring to FIG. 16, another embodiment of bow 10*b* is illustrated comprising another embodiment of a rotating member 100. Rotating member 100 is rotatably joined to limb 16 and an idler wheel 102 is rotatably secured to limb 14. A yoke 110 secures drawstring 22 to a cable assembly, for example to cable 106, more thoroughly described and illustrated in FIG. 21. It should be understood that rotating member 100 could be rotatably joined to limb 14, and idler wheel 102 rotatable secured to limb 16. Another embodiment includes no rotating member on limb 14 with string 22 extending between limb 14 and rotating member 100.

Figure 17:
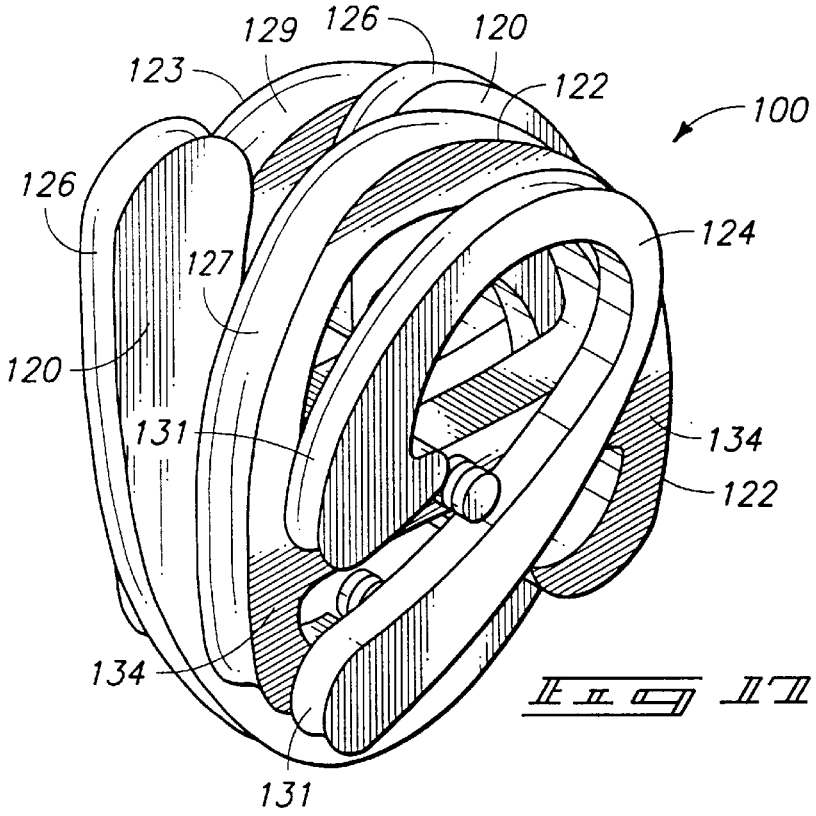
FIG. 17 is a perspective view of an archery bow cam in accordance with another embodiment of the present invention.
Figure 18:
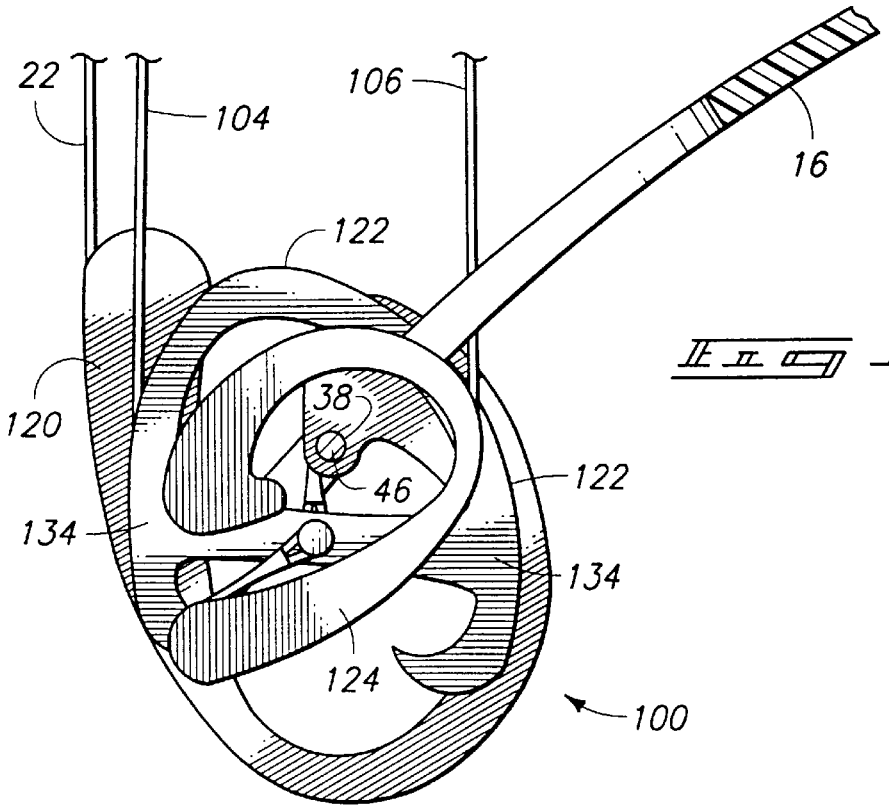
FIG. 18 is a fragmentary view of the archery bow of FIG. 16 emphasizing a side view of the archery bow cam of FIG. 17 shown at a rest position relative a full draw.

Referring to FIG. 17, rotating member 100 is illustrated and comprises a first cam 122 having an eccentric profile to provide a first camming surface 127. First cam 122 has a first outwardly facing surface 134. A second cam 123 has an eccentric profile to provide a second camming surface 129. Second cam 123 has a second outwardly facing surface 136 (shown in FIG. 21). A primary cam 120 is oriented between the first and second cams 122 and 123. The eccentric profile of the first cam 122 is substantially symmetrically oriented as a mirror image of the eccentric profile of the second cam 123 relative primary cam 120. A fourth cam 124 extends outwardly from the first outwardly facing surface 134 of the first cam 122 and the fourth cam 124 has an eccentric profile to provide a fourth camming surface 131. A fifth cam 125 (shown in FIG. 21) extends outwardly from the second outwardly facing surface 136 (shown in FIG. 21) of second cam 123. The fifth cam 125 has an eccentric profile to provide a fifth camming surface 132 (shown in FIG. 21). The eccentric profile of the fourth cam 124 is substantially symmetrically oriented as a mirror image of the eccentric profile of the fifth cam 125 relative the primary cam 120. First and second cams 122 and 123 are equidistant and parallel relative primary cam 120 and fourth and fifth cams 124 and 125 are equidistant and parallel relative primary cam 120. Accordingly, the cam design on either side of primary cam 120 is substantially symmetrical to balance forces in rotating member 100 associated with the tensile forces from the cables and string. The symmetry minimizes the twisting of limbs. It should be understood that an embodiment of bow 10*b* could include a rotating member 100 rotatably joined to limb 14 and a rotating member 100 rotatably joined to limb 16.

Figure 19:
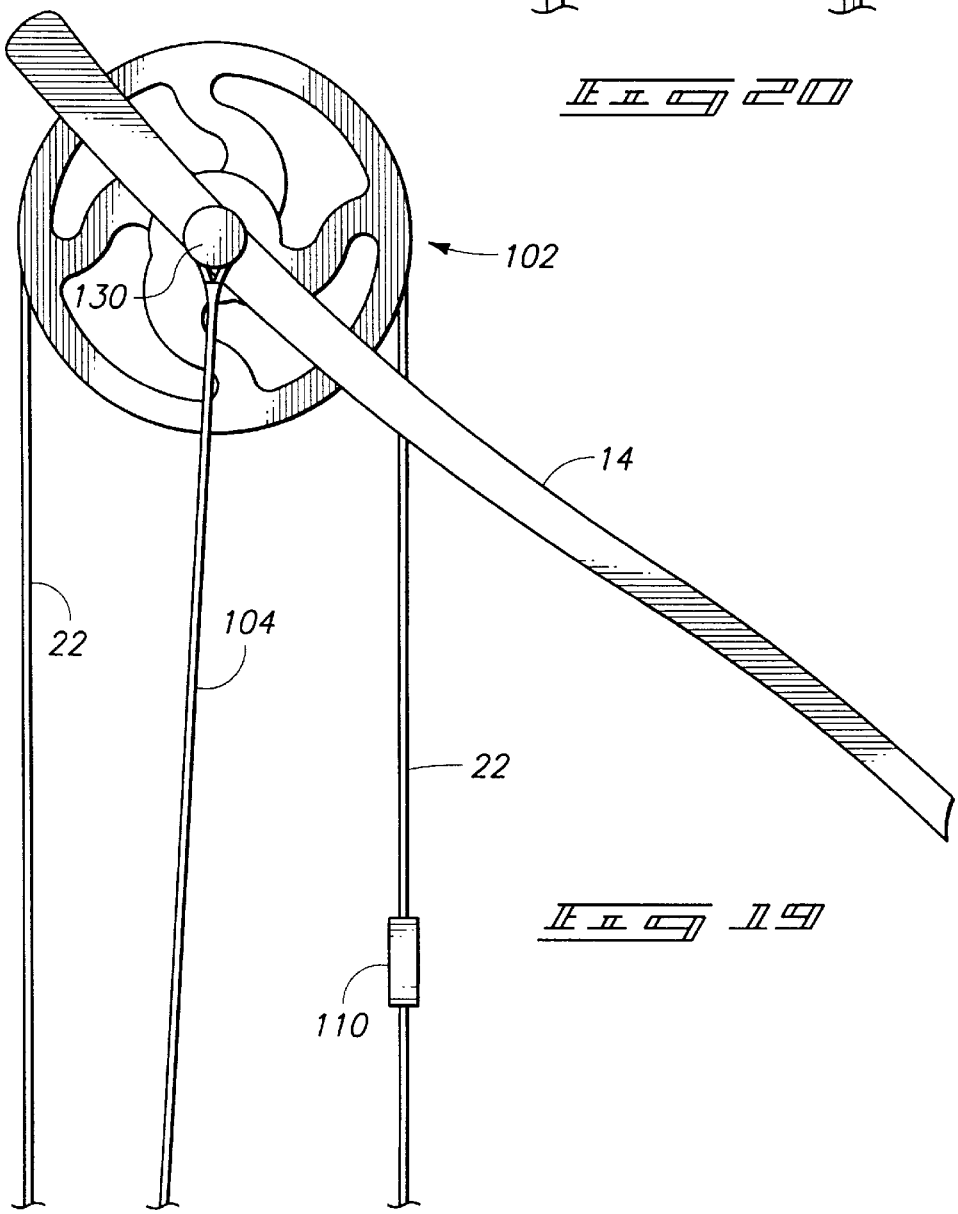
FIG. 19 is a fragmentary view of the FIG. 16 archery bow emphasizing an idler wheel in accordance with one embodiment of the present invention.

Referring to FIG. 19, an embodiment of bow 10*b* comprises an idler wheel 102 rotatably joined to limb 14. Idler wheel 102 includes a concentric profile defining a single centrally positioned groove 103 to receive string 22.

Figure 20:
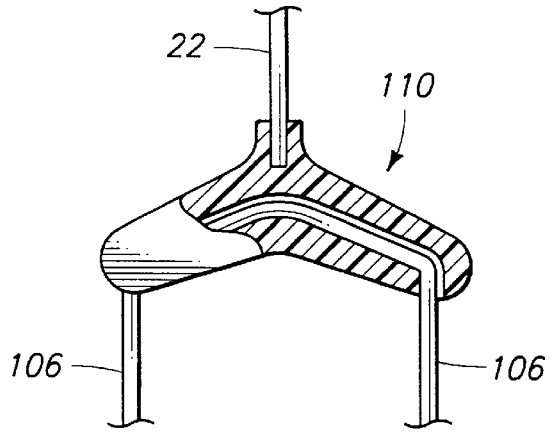
FIG. 20 is a partial sectional view of a yoke assembly in accordance with an embodiment of the present invention used with the FIG. 16 archery bow.

Referring to FIG. 20, an exemplary yoke 110 has string 22 terminating in yoke 110 and cable 106 slidingly held within yoke 110. It should be understood that various arrangements of string 22 and cable 106 could be designed. For example, string 22 could slidingly cooperate around or through yoke 110. Another example includes cable 106 with two ends terminating within yoke 110. Another embodiment includes string 22 branching off into two strings 106 without the use of the yoke 110. Yoke 110 comprises any material capable of handling the tensile stresses common in bow cables, for example, metal.

Figure 21:
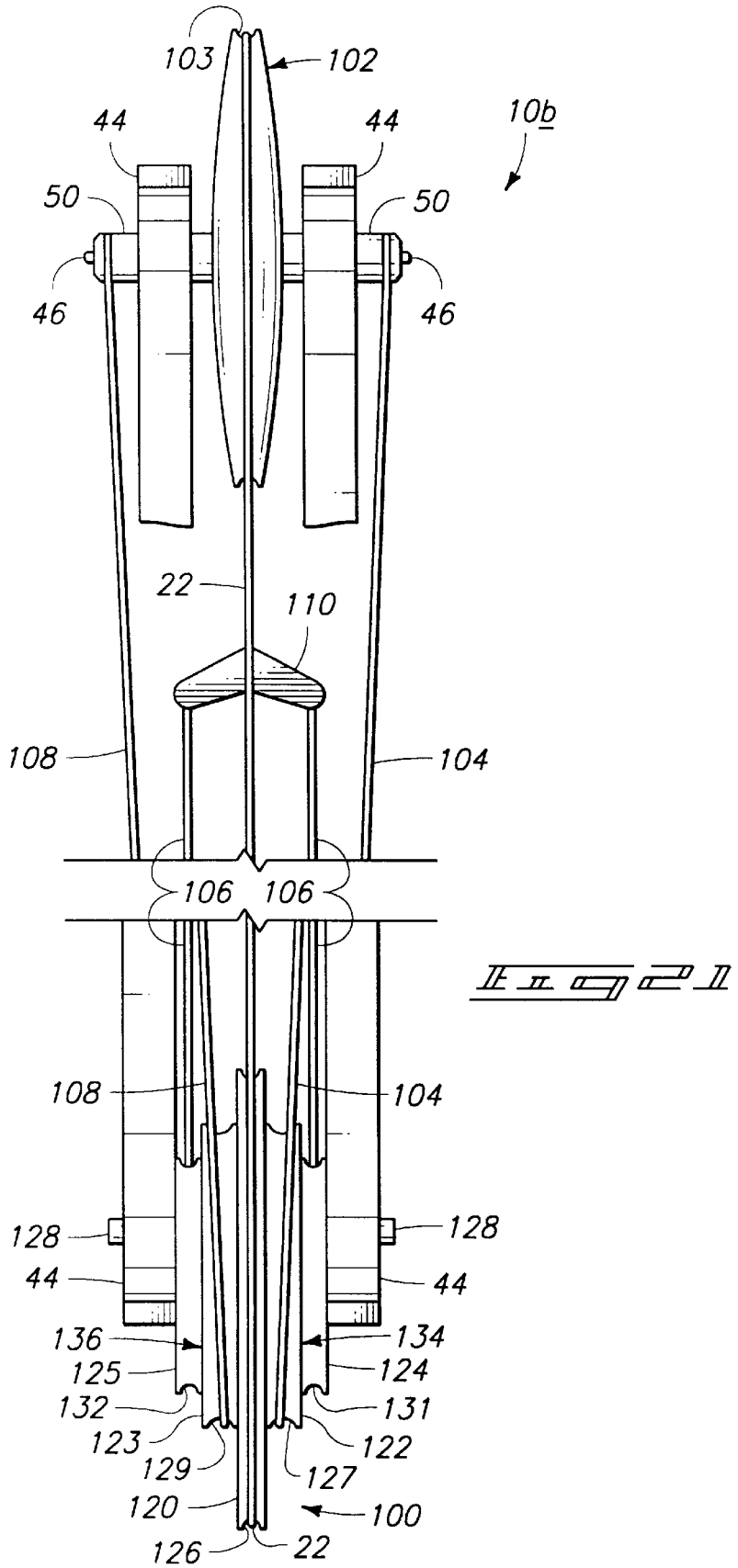
FIG. 21 is a fragmentary view of the FIG. 16 archery bow from the perspective of an archer using the bow.

Referring to FIG. 21, archery bow 10*b* is illustrated from the perspective of an archer using the bow 10*b*. Cable 106 is received by cams 124 and 125 and extends through yoke 110. Cable 104 is received by cam 122 and terminates at anchor 50 of limb 14 (only forked member 44 is shown) on the right side of bow 10*b*. Cable 108 is received by cam 123 and terminates at anchor 50 of limb 14 (only forked member 44 is shown) on the left side of bow 10*b*. The cable configuration on one side of bow 10*b* is a mirror image of the cable configuration on the other side once again establishing symmetry.

Figure 22:
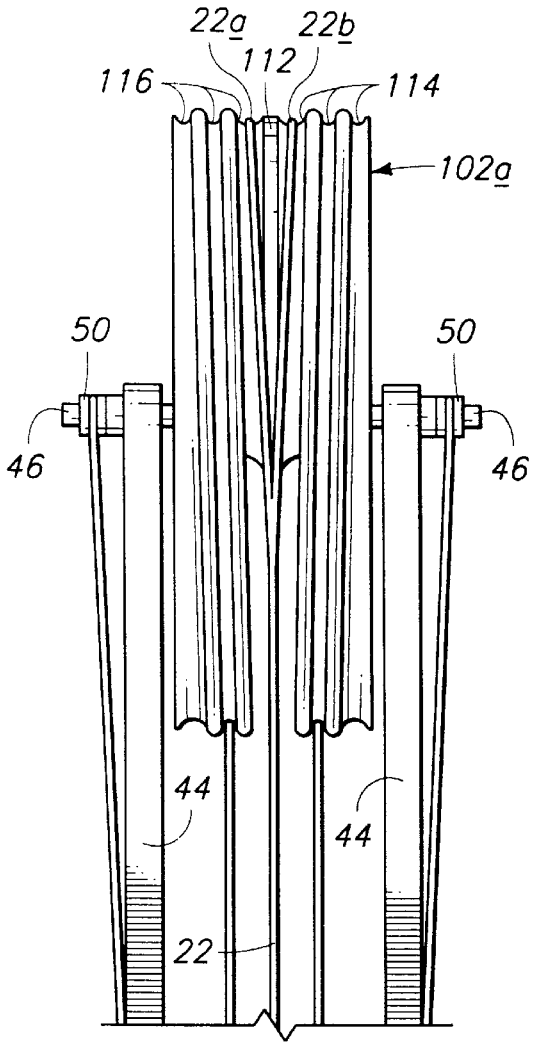
FIG. 22 is a fragmentary view of an archery bow emphasizing an idler wheel in accordance with another embodiment of the present invention, and shown at a rest position relative a full draw.
Figure 23:
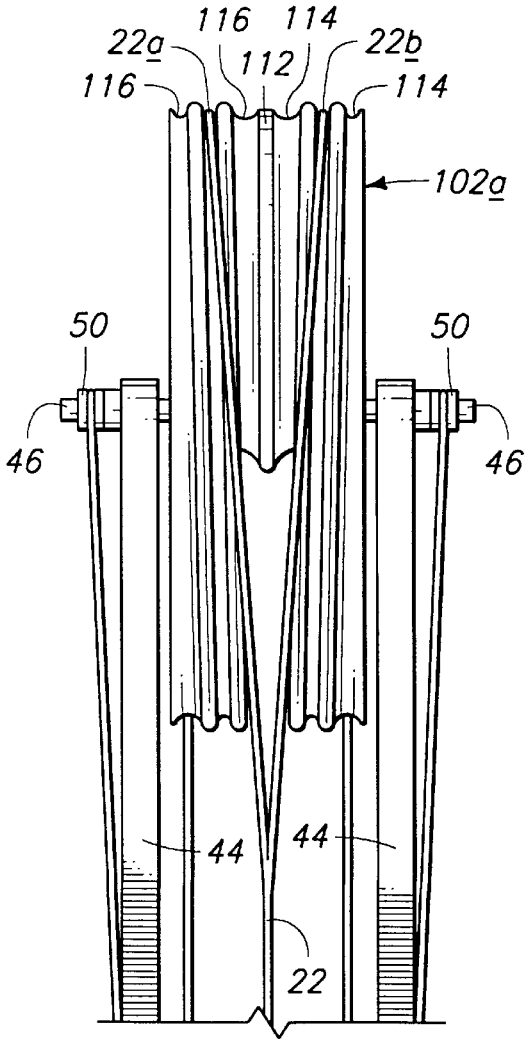
FIG. 23 is a view of the FIG. 22 archery bow shown at a full draw position.

Referring to FIGS. 22 and 23, another embodiment of idler wheel 102*a* is illustrated. In FIG. 22, idler wheel is shown in the rest position and comprises a central portion 112 and opposed helical grooves 114 and 116 substantially symmetrically oriented on either side of the central portion 112. The grooves receive string 22 wherein the string 22 splits into two cables 22*a* and 22*b* before riding on idler wheel 102*a*. Strings 22*a* and 22*b* are received on opposite sides of the central portion 112 in grooves most adjacent the central portion 112. Cable 22*a* rides in grooves 116 and cable 22*b* rides in grooves 114.

Referring to FIG. 23, idler wheel 102*a* is shown in a draw position. Idler wheel 102*a* rotates to move the two cables 22*a* and 22*b* in opposite directions by the opposed helical grooves 114 and 116. While this embodiment does not use yoke 110, the cables are still substantially symmetrically received over the idler wheel 102*a* to balance the tensile forces of the cables transferred into the bow.

Again referring to FIG. 22, cables 22*a* and 22*b* are illustrated beginning at the front of idler wheel 102*a*, riding over idler wheel 102*a* in grooves 116 and 114, respectively, and exiting the grooves 116 and 114 at the back of idler wheel 102*a* for a 180° wrap around idler wheel 102*a*. However, it should be understood that cables 22*a* and 22*b* could wrap an additional 360° (or any multiple thereof) around idler wheel 102*a* for a total of 540°. Furthermore, it should be understood that if cables 22*a* and 22*b* are to wrap around idler wheel 102*a* an additional number of times, for example, such as wrapping cables 22*a* and 22*b* around idler wheel 102*a* twice for a total of additional 720°, cables 22*a* and 22*b* may need to be longer than illustrated to accommodate the increased wraps, and idler wheel 102*a* may need to include more grooves 114 and 116 to accommodate the longer cables 22*a* and 22*b*.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An archery bow comprising:

a first limb and a second limb;

a handle between the limbs;

a rotating member comprising at least two cams rotatably joined to the first limb, a first of the two cams comprising an eccentric profile to provide a first camming surface and a second of the two cams comprising an eccentric profile to provide a second camming surface, the eccentric profile of the first cam is substantially symmetrical relative to the eccentric profile of the second cam; and a string extending between the rotating member and second limb.

2. The archery bow of claim 1 wherein the eccentric profile of the first cam is parallel to the eccentric profile of the second cam.

3. The archery bow of claim 1 wherein the eccentric profile of the first cam is substantially symmetrically aligned to the eccentric profile of the second cam.

4. The archery bow of claim 1 wherein the eccentric profile of the first cam is substantially symmetrically aligned and angled relative to the eccentric profile of the second cam.

5. The archery bow of claim 1 wherein the rotating member further comprises a primary cam in rotational cooperation with the first and second cams.

6. The archery bow of claim 1 wherein the rotating member further comprises a primary cam between the first and second cams.

7. The archery bow of claim 1 wherein the rotating member further comprises a primary cam between the first and second cams, the primary cam comprising an eccentric profile not substantially symmetrical relative the eccentric profiles of the first and second cams.

8. The archery bow of claim 1 wherein the rotating member further comprises a primary cam between the first and second cams, the primary cam comprises an eccentric profile parallel to the eccentric profiles of the first and second cams.

9. The archery bow of claim 1 wherein the rotating member further comprises a primary cam between the first and second cams, and wherein the first and second cams are equidistant from the primary cam.

10. The archery bow of claim 1 wherein the rotating member further comprises a primary cam between the first and second cams, and wherein the eccentric profile of the first cam is substantially symmetrically aligned relative to the eccentric profile of the second cam.

11. The archery bow of claim 1 wherein the rotating member further comprises a primary cam between the first and second cams, the primary cam comprises an eccentric profile, the eccentric profiles of the first and second cams are angled relative the eccentric profile of the primary cam, and the eccentric profile of the first cam forms substantially a mirror image of the eccentric profile of the second cam relative to the eccentric profile of the primary cam.

12. The archery bow of claim 1 wherein the rotating member is further comprises a primary cam between the first and second cams, and wherein the first and second cams are integrally formed with the primary cam to form a single integral structure for the rotating member.

13. The archery bow of claim 1 wherein the rotating member further comprises a primary cam between the first and second cams, and the first and second cams are discrete structures removably attached to the primary cam.

14. The archery bow of claim 1 wherein the rotating member further comprises a primary cam between the first and second cams, and at least one of the first and second cams is a discrete structure removably attached to the primary cam.

15. The archery bow of claim 1 further comprising a member rotatably joined to the second limb.

16. The archery bow of claim 1 further comprising at least one generally cylindrical anchor removably attached to a limb and comprising a plurality of discrete circumferential grooves with each groove laterally spaced from the limb.

17. The archery bow of claim 1 further comprising a rotating component rotatably joined to the second limb, the string extending between the rotating member and rotating component.

18. The archery bow of claim 1 wherein the rotating member further comprises a primary cam between the first and second cams, the first cam comprises a first outwardly facing surface and the second cam comprises a second outwardly facing surface, a fourth cam extends outwardly from the first outwardly facing surface, a fifth cam extends outwardly from the second outwardly facing surface.

19. The archery bow of claim 18 wherein the fourth cam comprises an eccentric profile to provide a fourth camming surface and the fifth cam comprises an eccentric profile to provide a fifth camming surface, the eccentric profile of the fourth cam is substantially symmetrical relative to the eccentric profile of the fifth cam.

20. The archery bow of claim 18 wherein the fourth cam is aligned in substantially a mirror image relationship with the fifth cam.

21. An archery bow comprising:

a pair of flexible resilient bow limbs forming first and second outer bow limb ends and forming first and second inner bow limb ends;

a handle connecting the first and second inner bow limb ends;

a string extending between the first and second outer bow limb ends; and at least four cables extending between the first and second outer bow limb ends.

22. The archery bow of claim 21 wherein the four cables are discrete cables relative to one another.

23. The archery bow of claim 21 further comprising at least one cable anchor laterally extending from an outer bow limb end, the cable anchor comprising generally a cylindrical surface having a plurality of discrete circumferential grooves, each groove laterally displaced from an adjacent groove.

24. The archery bow of claim 21 wherein each outer bow limb end comprises two laterally outwardly facing sides, and the archery bow further comprises at least one cable anchor laterally extending outwardly from each laterally outwardly facing side, the cable anchors comprising a plurality of discrete grooves, each groove laterally displaced from an adjacent groove.

25. The archery bow of claim 24 wherein the four cables are discrete cables relative to one another, and each cable comprises two terminal ends, one terminal end secured to one cable anchor of one outer bow limb end and the other terminal end secured to the other outer bow limb end, the two terminal ends of each cable secured to the same side of the first and second outer bow limb ends.

26. The archery bow of claim 21 wherein the archery bow comprises opposed sides, two of the four cables extend between first and second outer bow limb ends on one side of the bow, and the other two cables extend between first and second outer bow limb ends on the other side of the bow.

27. An archery bow comprising:

a handle;

a first flexible bow limb and a second flexible bow limb, the first and second bow limbs being mounted on and projecting oppositely from the handle and terminating in first and second bow limb tips, respectively;

a string extending between the first and second bow limb tips; and at least one cable anchor laterally extending from one flexible bow limb, the cable anchor comprising an outward surface having a plurality of peripheral discrete grooves, each groove laterally displaced from an adjacent groove.

28. The archery bow of claim 27 wherein each bow limb tip defines a slot having inside surfaces, the cable anchor laterally extending inwardly from the inside surfaces.

29. The archery bow of claim 27 wherein each bow limb tip comprises outwardly facing opposed surfaces, the cable anchor laterally extending outwardly from one outwardly facing surface.

30. The archery bow of claim 27 further comprises an axle secured within each bow limb tip and the cable anchor laterally extends from one bow limb tip removably secured on the axle.

31. The archery bow of claim 27 further comprises an axle secured within each bow limb tip and the cable anchor comprises an opening contoured to securely receive the axle.

32. The archery bow of claim 27 further comprises an axle secured within each bow limb tip and the cable anchor comprises an opening contoured to receive the axle and allow adjusting movement of the axle within the cable anchor.

33. The archery bow of claim 27 further comprises an axle secured within each bow limb tip and each bow limb tip comprises two sides with each side facing laterally outwardly opposite the other side, a cable anchor laterally extends outward from each side of each bow limb tip removably secured on the axle.

34. An archery bow comprising:

a first limb and a second limb;

a handle between the limbs; and at least one cable extending between the first and second limbs, the cable having a diameter dimension greater than 0 inches and ranging from about 3/32 inch to less than 1/8 inch.

35. The archery bow of claim 34 wherein the at least one cable comprises a diameter dimension ranging from about 3/32 inch to less than 1/8 inch.

36. The archery bow of claim 34 further comprising a string having diameter dimensions ranging from about 1/16 inch to less than 3/16 inch.

37. The archery bow of claim 34 wherein each limb comprises two laterally outwardly facing sides, and the archery bow further comprises at least one cable anchor laterally extending outwardly from each laterally outwardly facing side, the cable anchors comprising generally a cylindrical shape having a plurality of discrete circumferential grooves, each groove laterally displaced from an adjacent groove and capable of receiving the cable, the cable capable of being positioned laterally outward from the archery bow by positioning the cable in a more outward groove relative the archery bow.

38. The archery bow of claim 34 further comprising a plurality of cables with at least two of the cables having diameter dimensions ranging from about 3/32 inch to less than 1/8 inch.

39. The archery bow of claim 34 further comprising four cables and a string, the string having diameter dimensions ranging from about 1/16 inch to less than 3/16 inch.

40. The archery bow of claim 34 further comprising four cables and a string, the cables having diameter dimensions ranging from about 3/32 inch to less than 3/8 inch and the string having diameter dimensions ranging from about 1/16 inch to less than 3/16 inch.

41. An archery bow comprising:

a handle having opposing ends;

a first flexible limb and a second flexible limb, each limb extending outwardly from the handle opposing ends, and each limb having a distal end;

an axle secured within the distal end of the first flexible limb;

a rotating member secured on the axle;

a string extending between the rotating member and a region proximate the distal end of the second flexible limb;

at least two discrete bearings rotatably mounted on the axle to rotatably support the rotating member; and wherein the rotating member comprises a primary cam between two secondary cams.

42. The archery bow of claim 41 further comprising one discrete bearing contacting one secondary cam and the other discrete bearing contacting the other secondary cam.

43. The archery bow of claim 41 further comprising a plurality of discrete bearings spaced from each other for evenly distributing and balancing the support weight of the rotating member on each bearing.

44. The archery bow of claim 41 further comprising at least one cable and at least one cable anchor laterally extending from one limb, the cable anchor comprising generally a cylindrical shape having a plurality of discrete circumferential grooves, each groove laterally displaced from an adjacent groove and capable of receiving the cable.

45. The archery bow of claim 41 wherein the primary cam has two outward sides, the primary cam between a plurality of secondary cams, a plurality of secondary cams on each side of the primary cam, one discrete bearing supporting the rotating member on one side of the primary cam and the other discrete bearing supporting the rotating member on the other side of the primary cam, the discrete bearings equidistant from the primary cam.

46. The archery bow of claim 41 wherein the primary cam has two outward sides, the primary cam between a plurality of secondary cams, a plurality of secondary cams on each side of the primary cam, a plurality of discrete bearings spaced from each other for evenly distributing and balancing the support weight of the rotating member on each bearing.

47. An archery bow comprising:

a first limb and a second limb;

a handle between the limbs;

a first rotating member comprising at least two cams rotatably joined to the first limb, a first of the at least two cams comprising an eccentric profile to provide a first camming surface and a second of the at least two cams comprising an eccentric profile to provide a second camming surface, the eccentric profile of the first cam is substantially symmetrical relative to the eccentric profile of the second cam;

a second rotating member comprising at least two cams rotatably joined to the second limb, a third of the at least two cams comprising an eccentric profile to provide a third camming surface and a fourth of the at least two cams comprising an eccentric profile to provide a fourth camming surface, the eccentric profile of the third cam is substantially symmetrical relative to the eccentric profile of the fourth cam; and a string extending between the first and second rotating members.

48. The archery bow of claim 47 wherein the first rotating member comprises a primary cam between the first and second cams and the second rotating member comprises a primary cam between the third and fourth cams.

49. The archery bow of claim 47 wherein the first rotating member comprises a first primary cam between the first and second cams and the second rotating member comprises a second primary cam between the third and fourth cams, the first and second cams are parallel and equidistant relative the first primary cam and the third and fourth cams are parallel and equidistant relative the second primary cam.

50. The archery bow of claim 49 wherein the string has two ends and extends between the first and second primary cams with one end secured to the first rotating member and the other end secured to the second rotating member, the string and primary cams establish a centrally vertical plane through the archery bow to define a right side of the bow and a left side of the bow opposite the right side relative the plane.

51. The archery bow of claim 50 further comprising four cables, two cables positioned between the limbs on the right side of the plane and two cables positioned between the limbs on the left side of the plane, the two cables on one side are secured to the bow in the same fashion as the two cables on the other side.

52. The archery bow of claim 51 wherein each cable comprises two ends, the two cables on the right side comprise one cable having one end secured to the first limb and the other end secured over the fourth cam to the second rotating member of the second limb and the other cable on the right side having one end secured to the second limb and the other end secured over the second cam to the first rotating member of the first limb, and the two cables on the left side of the plane configured the same as the right side cables.

53. The archery bow of claim 52 wherein the ends of the cables secured to the limbs are secured to the limbs by cable anchors, the cable anchors having a plurality of discrete peripheral grooves to receive the cable ends, the grooves generally parallel to the plane established by the string and primary cams and each groove laterally spaced from the adjacent groove.

54. An archery bow comprising:

a central handle having opposing ends;

a first flexible power limb extending outwardly from one handle end and a second flexible power limb extending outwardly from the other handle end, each of the limbs having an inner end connected with the handle and an outer free end;

a rotating member rotatably joined to the outer free end of the first flexible power limb, the rotating member comprising:

a first cam comprising an eccentric profile to provide a first camming surface, the first cam having a first outwardly facing surface;

a second cam comprising an eccentric profile to provide a second camming surface, the second cam having a second outwardly facing surface;

a primary cam between the first and second cams, and wherein the eccentric profile of the first cam is substantially symmetrically oriented as a mirror image of the eccentric profile of the second cam relative the primary cam;

a fourth cam extending outwardly from the first outwardly facing surface of the first cam, the fourth cam comprising an eccentric profile to provide a fourth camming surface; and a fifth cam extending outwardly from the second outwardly facing surface of the second cam, the fifth cam comprising an eccentric profile to provide a fifth camming surface, and wherein the eccentric profile of the fourth cam is substantially symmetrically oriented as a mirror image of the eccentric profile of the fifth cam relative the primary cam; and a string extending between the rotating member and the outer free end of the second flexible power limb.

55. The archery bow of claim 54 wherein the outer free end of the second flexible power limb rotatably supports an idler wheel comprising opposed helical grooves to receive the string.

56. The archery bow of claim 54 wherein the outer free end of the second flexible power limb rotatably supports an idler wheel comprising a central portion with opposed helical grooves substantially symmetrically oriented on either side of the central portion, the grooves receive the string.

57. The archery bow of claim 54 wherein the outer free end of the second flexible power limb rotatably supports an idler wheel comprising a central portion with opposed helical grooves substantially symmetrically oriented on either side of the central portion, the grooves receive the string, and wherein the string splits into two cables before received in the grooves.

58. The archery bow of claim 54 wherein the outer free end of the second flexible power limb rotatably supports an idler wheel comprising a central portion with opposed helical grooves substantially symmetrically oriented on either side of the central portion, the grooves receive the string, and wherein the string splits into two cables before received in the grooves, the two cables are received in the grooves most adjacent the central portion wherein rotation of the idler wheel moves the two cables in the opposed helical grooves to space apart the two cables.

59. An archery bow anchor comprising:

an outward surface having a plurality of peripheral discrete grooves, each groove laterally displaced from an adjacent groove; and an opening extending axially through the anchor and dimensioned to receive a bow axle.

60. The archery bow anchor of claim 59 wherein the opening is dimensioned to allow adjusting movement of the axle.

61. The archery bow anchor of claim 59 wherein the outward surface defines generally a cylindrical shape.

62. An archery bow cam assembly comprising:

a first cam comprising an eccentric profile to provide a first camming surface;

a second cam comprising an eccentric profile to provide a second camming surface, the eccentric profile of the first cam is substantially symmetrical relative to the eccentric profile of the second cam; and a primary cam between the first and second cams.

63. The archery bow cam assembly of claim 62 wherein the eccentric profile of the first cam is substantially symmetrically aligned to the eccentric profile of the second cam.

64. The archery bow cam assembly of claim 62 wherein the eccentric profile of the first cam forms substantially a mirror image of the eccentric profile of the second cam relative the primary cam, and the first and second cams are angled relative the primary cam.

65. The archery bow cam assembly of claim 62 wherein the primary cam comprises an eccentric profile not substantially symmetrical relative the eccentric profiles of the first and second cams.

66. The archery bow cam assembly of claim 62 wherein at least one of the first and second cams is a discrete structure removably attached to the primary cam.

67. The archery bow cam assembly of claim 62 wherein the first cam comprises a first outwardly facing surface and the second cam comprises a second outwardly facing surface, a fourth cam extends outwardly from the first outwardly facing surface of the first cam, a fifth cam extends outwardly from the second outwardly facing surface of the second cam.

68. The archery bow cam assembly of claim 67 wherein the fourth cam comprises an eccentric profile to provide a fourth camming surface and the fifth cam comprises an eccentric profile to provide a fifth camming surface, the eccentric profile of the fourth cam is substantially symmetrical relative to the eccentric profile of the fifth cam.

69. The archery bow cam assembly of claim 67 wherein the fourth cam is aligned in substantially a mirror image relationship with the fifth cam.

* * * * *